United States Patent [19]

Schonert

[11] 4,281,491

[45] Aug. 4, 1981

[54] MODULAR WALL FRAMING

[76] Inventor: Ernest A. Schonert, 6536 Via Corral, Anaheim, Calif. 92807

[21] Appl. No.: 9,381

[22] Filed: Feb. 2, 1979

[51] Int. Cl.[3] ..... E04B 2/70

[52] U.S. Cl. ..... 52/281; 52/481

[58] Field of Search ..... 52/281, 481, 348

[56] References Cited

U.S. PATENT DOCUMENTS

| | | | |
|---|---|---|---|
| 533,856 | 2/1895 | Baker | 52/481 |
| 1,551,994 | 9/1925 | Latimer | 52/481 |
| 1,983,020 | 12/1934 | De Vol | 52/281 |
| 2,118,237 | 5/1938 | Slayter | 52/481 |
| 2,362,162 | 11/1944 | Sheldon | 52/481 |
| 2,803,856 | 8/1957 | Kofahl | 52/481 |
| 3,464,170 | 9/1969 | Grover | 52/240 |
| 3,774,362 | 11/1973 | Matuschek | 52/281 |

*Primary Examiner*—John E. Murtagh
*Assistant Examiner*—Henry E. Raduazo
*Attorney, Agent, or Firm*—K. H. Boswell

[57] ABSTRACT

A wall construction of the type having horizontal sole plates which are attached to a foundation and a series of vertical studs which extend from the sole plates can be improved by constructing a building or other structure using individual modular sections for the wall construction. Each of the individual modular sections has a sole plate which is attached to or otherwise fastened to the foundation or other supporting structure. Resting on top of and attached to each end of the sole plate is a vertical end stud. Traversing across the top of the end studs is a singular top plate. The end studs are perpendicular to the sole plate and the end studs; the sole plate and the top plate all lie in the same plane. Extending between the top plate and the sole plate and placed a unit distance away from each end stud is a vertical interior stud. Depending upon the length of the modular section additional vertical interior studs are also symmetrically spaced between the end studs. Between each end stud and the vertical interior stud immediately adjacent to it, are a series of cross braces, normally three in number, which extend horizontally between the end stud and the vertical stud adjacent to it. Additionally at the point where two modular units intersect to form perpendicular walls, a third set of cross braces are attached to two adjacent interior studs and the intersecting modular unit is then attached to this third set of cross braces.

8 Claims, 6 Drawing Figures

MODULAR WALL FRAMING

BACKGROUND OF THE INVENTION

This invention is directed to a wall construction wherein individual modular units which utilize a series of cross braces proximal to both ends of each individual modular unit are used in the construction.

In recent times man has had to face the reality that there are only a limited amount of resources available on this planet for his use. Included in the group of resources which man must learn to conserve are both construction materials and fuels. In constructing buildings, factories and homes, construction techniques must take into account both local and national construction codes. These construction codes were designed to provide both safe buildings and to insure that the consumer was getting an equitable value for his money.

Many local building codes and/or construction techniques were enacted or came into use during prior decades when both construction materials and fuels were in more plentiful supply. Additionally, construction labor costs were lower in respect to average income and therefore housing and other buildings were more attainable for the average individual.

In building a standard frame house a foundation is layed and on top of the foundation along the perimeter of the foundation a series of sole plates are layed down and attached to the foundation, either by bolts preset into the foundation or by spikes or nails driven into the foundation through the sole plates. Generally, most building codes consider a standard 2×4 as adequate for the sole plates. Extending from the sole plate at typically 16 inch centers are 94 inch studs. On top of the studs are placed two top plates. The top top plate or tie plate is, in effect, used to hold the individual bottom top plates into a unit structure.

Arrangement of the studs at both outside and inside corners can be one of several acceptable assemblies. At each corner a section of wood from the corner studs must be exposed along each wall. This is necessary to attach either lathing (old construction) or drywall to the studs at the corner. Typically this is accomplished by having three 2×4's assembled together such that they form a 4×6 (for the purposes of this specification wood removed in planing the lumber from rough stock to finished stock will be ignored) and then placing a fourth 2×4 with its 4 inch side along the 6 inch side of the other group of three 2×4's. This allows a 2 inch extension of wood to project at the corner for tacking the drywall.

As alternate construction actually utilizes a 4×6 in place of the three 2×4's, plus the additional 2×4 as was previously described. Other constructions utilize three 2×4's at each corner and leave a 2×4 space near the outside wall. As with the previously described construction these constructions are designed to leave a strip of wood along each side of the corner on which to tack the drywall.

Within the interior of a building standard methods of joining an interior partition or wall to an outside wall at a standard 90 degree angle include the use of either two 2×4's spaced approximately two inches away from each other along the outside wall and a third 2×4 attached to these other two, forming the end portion of the partition, or using larger lumber such as two 2×6's jointly between the outside wall and the partition wall and tacking on a 1×2 on each six foot side of the 2×6's for joining wall boards to the framing.

It is standard when forming windows or doorways to have a header traverse the space between the studs on top of the window or doorway and have a series of cripples between the header and the top plates. For doorways, between the floor and the header on the inside of the doorway, and for windows, between the sill and the header on the inside of the window, trimmers are attached.

As can be gleaned from examining these methods of construction a large portion of the lumber used in framing a structure is utilized just in joining walls together and for each piece of lumber which must be joined to another piece of lumber, construction labor time is spent.

In warm climates, houses are usually constructed without basements and utilize concrete slabs as foundations. When the slab is poured bolts are embedded in the concrete to which the sole plates are attached. If the slab is finished with a concrete finishing machine it is very difficult to make sure that the portions of the slab between the bolts on which the sole plates rest are smooth and level. As a result, spaces can be left between the sole plate and the slab and/or the wall will not be "true" and square.

In all but the warmest climates, insulation is placed inbetween the spaces between the studs in the walls of a structure. This effectively prevents heat loss through these areas; however, wherever a 2×4 or other wall structure traverses between the inside and outside wall of the structure heat loss can occur both through the 2×4 or other board and along the seams wherein two boards join. It is obvious that the greater the amount of individual boards and/or seams in a wall the greater the heat loss will be along that wall.

In addition to the desire to conserve resources with rising construction labor costs it is also advantageous to construct a structure in such a manner that labor is minimized. With the recent rise in construction costs this factor is adding to other economic factors which are placing ownership of a home out of range of the common individual.

BRIEF DESCRIPTION OF THE INVENTION

In view of the above it is considered that there exists the need for new construction techniques which minimizes the amount of materials needed in constructing a structure, minimizes the labor in constructing the structure, and minimizes the uses of fuel to heat or cool the structure once it is completed. It is therefore a broad object of this invention to fulfill these needs.

It is a further object of this invention to provide a wall construction consisting of modular panels which can be standardized and therefore prepared in a factory as opposed to on-site construction, yet when assembled into a complete structure the individual modular panels are of such a nature that the structures will meet or exceed any building code requirements for that structure. It is a further object of this invention to lower the manufacturing costs of a structure by lowering that portion of the costs which are attributable to the framing, thus providing a lower cost unit for the consumer.

In view of these and other objects which will become evident upon further reading of this specification these objects are met by providing a wall construction of the type having horizontal sole plates resting on a foundation or other supporting structure and a series of vertical studs extending from said sole plates, the improvement which comprises: said wall construction being divided into individual, modular sections and each individual modular section including a sole plate, said sole plate being capable of being fastened to said foundation, and said sole plate having a first and a second end; a top plate also having a first and second end; a first and second vertical end stud each having a top and bottom; the bottom of each said vertical end stud attaching to the first and second end respectively of said sole plate such that said end studs rest on and are perpendicular to said sole plate; the top plate resting on and attaching to the top end of said first and second end studs respectively, such that said end studs, said sole plate, and said top plate all lie in the same plane and form a quadrilateral, at least one interior vertical stud spaced a unit length away from both said first and said second end studs and extending between said top plate and said sole plate and lying in the same plane as, and parallel to, said first and said second end stud; a first and second plurality of horizontal cross braces, said first plurality of cross braces extending between said first end stud and the interior vertical stud adjacent to it, and said second plurality of horizontal cross braces extending between said second end stud and the interior vertical stud adjacent to it, each of said members of said first and second plurality of cross braces being substantially perpendicular to its respective end stud and each of said members of said first and second plurality of cross braces symmetrically spaced between said sole plate and said top plate, and attaching means for attaching all of the members of the modular unit together.

Further, where a first individual modular section will be so placed in the completed structure such that a second modular section forming an interior wall or partition extends perpendicular to said first modular section, said second modular section includes a third plurality of cross braces extending between two respective interior studs which lie on either side of the interior wall or partition such that said third plurality of cross braces form an attachment point on the first modular section for the end stud of the second modular section.

BRIEF DESCRIPTION OF THE DRAWING

It is considered that this invention will be more fully understood when taken in conjunction with the drawings in which.

Figure 1:
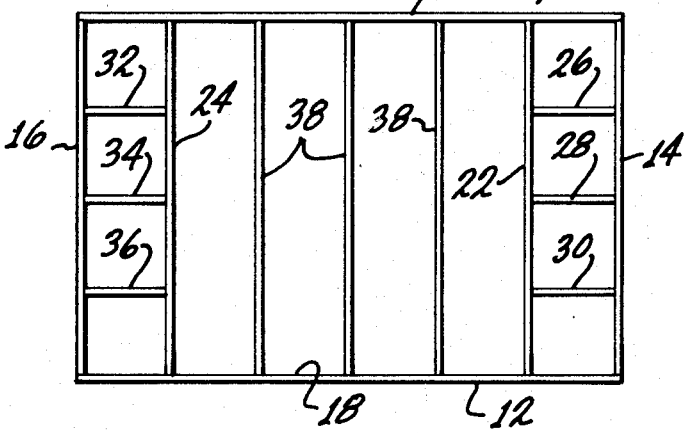
FIG. 1 is a plan view of a modular unit of the invention having a plurality of interior vertical studs.

The invention described in this specification and in the drawings uses certain operative principles and concepts as are set forth and defined in the appended claims to this specification. Those skilled in the construction art will realize these concepts and/or principles could easily be applied to a number of differently appearing or differently described embodiments. For these reasons the invention is not to be considered as limited to the exact embodiment herein described, but is to be constructed in accordance with the appended claims.

DETAILED DESCRIPTION

In FIG. 1 there is shown a standard modular section 10 which when used in conjunction with other similar modular sections, together forms the framing of the walls of a structure (not shown). The modular section 10 has certain components which are standard in all other modular sections to be used in a wall construction and certain variables which allow for different sizes and lengths of other modular sections. In describing those components which are found or which are part of each modular section the same number will be used throughout each figure in order to simplify the description and to promote understanding of the essence of each of the modular sections.

A sole plate 12 normally consisting of a standard wolmanized 2×4 is used as the bottom-most piece in forming the modular section 10. Extending from each end of the sole plate 12 is an end stud. These end studs for purposes of this specification will be noted as the first end stud 14 (on the right hand side of the figure) and the second end stud 16 (on the left hand side of the figure). The end studs 14 and 16 rest on the top surface 18 of the sole plate 12, and are attached thereto by means of nails, bolts, screws, glue, gang nails (self-nailing plates) or straps. These attaching means are not separately drawn or numbered since they may universally be interchanged depending on local building codes, etc.

The first and second end studs 14 are perpendicular to sole plate 12 and normally would be construction grade 2×4 studs. For the use on outside walls normally 94 inch studs will be chosen. For use on inside walls which are not required to support the weight of trusses or other super structures, a 93½ inch stud would be used. Lying on top of and attached to the respective tops of end studs 14 and 16 is a singular top plate 20. As with sole plate 12 and end studs 14 and 16, top plate 20 would normally be a construction grade 2×4 and depending upon the length of the modular section 10, as hereinafter described, the length of the sole plate 12 and the top plate 20 will be governed by the placement of the particular modular section 10 in the completed wall.

A series of interior vertical studs are placed perpendicular to the sole plate 12 between sole plate 12 and top plate 20. The number of these interior studs will be governed by the length of the modular section 10. The interior stud 22 next adjacent to the first end stud 14 and the interior stud 24 next adjacent to the second end stud 16 are attached to the end studs 14 and 16 respectively by a series of cross braces 26, 28, 30, 32, 34 and 36. The remaining interior studs, all collectively identified by the numeral 38, are held inbetween sole plate 12 and top plate 20 and spaced between interior studs 22 and 24 at a distance from each other which is governed by both local building code and/or economy of lumber. Normally interior studs 22 and 24 will be spaced 24 inches on center from the respective end studs 14 and 16 and interior studs 38 will also be spaced 24 inches on center between themselves and interior studs 22 and 24. Typically most building codes require construction 16 inches on center between studs. However, by using the modular sections 10 building code requirements as to adequacy of support of super structures over the walls can be met having the studs making up the modular sections 10 at 24 inch on center spacing. If desired, other spacing could be used including the standard 16 inch on center spacing. Further, if desired, in place of 2×4's for use in preparing the modular sections 10, other lumber sizes could be used--i.e., 2×6's.

Cross braces 26 through 30 are placed horizontally between end stud 14 and interior stud 22. These cross braces are substantially perpendicular to both the end stud 14 and the interior stud 22. For the standard eight foot high wall, cross brace 26 will be placed two feet from sole plate 12, cross brace 28 will be placed four feet from sole plate 12, and cross brace 30 will be placed six feet from sole plate 12. This spacing presents a symmetrical array of cross braces between the sole plate 12 and the top plate 20.

When end stud 14 and interior stud 22 are placed at 24 inches apart from each other, the total amount of lumber in cross braces 26, 28 and 30 is six running feet. The significance of this amount of lumber will become evident below when it is described how two modular sections 10 are connected together. Contrary to the other lumber grades used in the modular section 10 the cross braces 26 through 30 can be cut from utility grade lumber instead of construction grade lumber, thus effecting an economic savings. Cross braces 32, 34 and 36 fit between end studs 16 and interior stud 24 in exactly the same manner as was described for cross braces 26 through 30.

Figure 2:
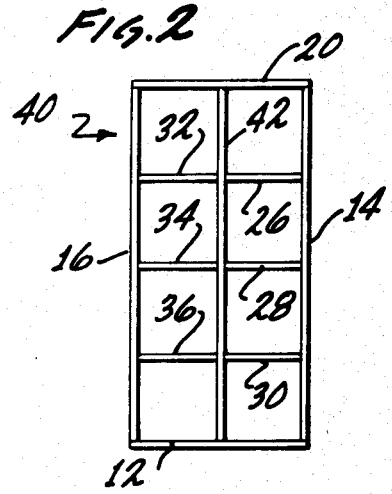
FIG. 2 is a plan view of a modular unit of the invention having a singular interior vertical stud.

In constructing the walls for a building, architectural considerations will require that the walls be of different lengths. In FIG. 2 there is shown a modular section 40 which is shorter than section 10 previously described. Instead of cross bracing between end studs 14 and 16 to interior studs 22 and 24 respectively as shown in FIG. 1, modular section 40 utilizes a singular interior stud 42 to which the cross braces are attached. Thus, if the end studs and the interior stud are placed at 24 inch centers the modular section 40 would be four feet in length. A third modular section (not illustrated) for use in very short sections would have no interior studs corresponding to interior studs 42, or 22 and 24, as previously described, but would consist of simply two end studs having one set of cross braces traversing between the two end studs.

The size of each individual modular section will be governed by the length of the wall wherein that unit is located. The maximum length of the individual modular sections will be governed by the length of lumber available for use in the sole plate 12 and top plate 20. Normally modular sections of up to 16 feet could be prepared using existing standardized sizes of lumber. Longer modular sections could be formed from bigger pieces of lumber specially cut. The smallest dimension for the modular section, such as for use in archways, will be governed strictly by the architectural plans of the building since the cross braces can be cut to any desired length.

Figure 4:
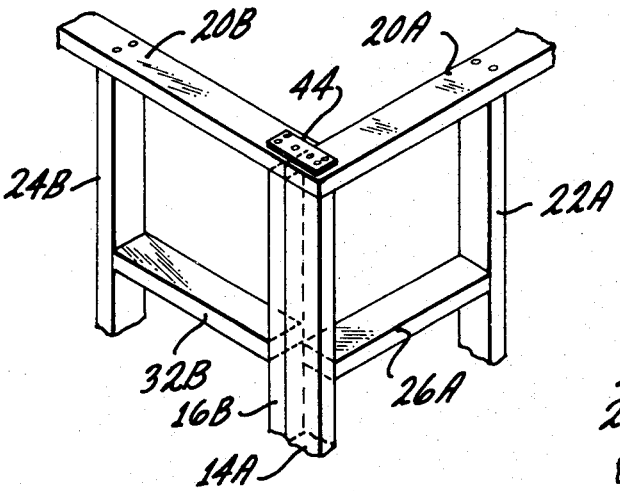
FIG. 4 is an isometric view of the outside corner shown in FIG. 3.
Figure 3:
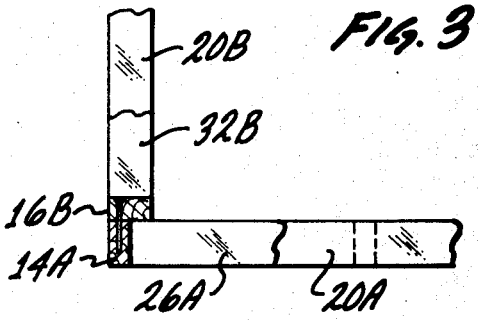
FIG. 3 is a top view partially broken away showing two modular units forming an outside corner.

In FIGS. 3 and 4 two modular sections 10 are placed together to form an outside corner. For the purpose of identification the components of one modular section 10 will be identified by the numeral followed by the letter "A" and similar components of the second modular section by the numeral followed by the letter "B". The two modular sections 10A and 10B are mated together to form a 90° corner by simply abutting second end stud 16B of modular section 10B with first end stud 14A of modular section 10A. A plate strap 44 can be used to tie top plate 20A to top plate 20B as is depicted in FIG. 4 and additionally, nails or other attaching means can be used to tie end stud 14A to end stud 16B. Additionally, since the four-inch dimension of stud 16B is abutting against the two-inch dimension of stud 14A the portion furthermost to the left of cross braces 26A, (and 28B and 30B not shown in the figures) fits next to a portion of end stud 16B which allows nails to be driven into end stud 16B and pass into these furthermost to the left portions of the cross braces.

In contrast with the construction methods noted in the Background of prior art where at least four 8-foot 2×4's were used to form a corner thus requiring 32 feet of 2×4's, by using two modular sections as described only two 8-foot 2×4's and six 2-foot cross braces are used totaling 28 feet of 2×4's.

Figure 5:
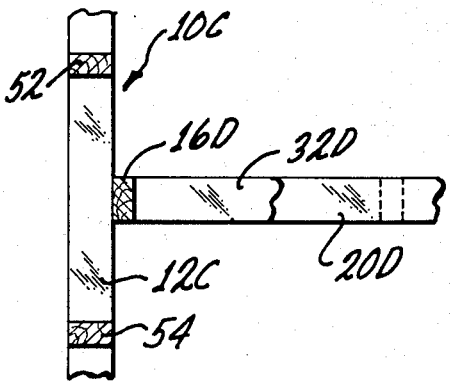
FIG. 5 is a top view partially broken away showing two modular units forming an inside corner wherein a partition meets an outside wall.
Figure 6:
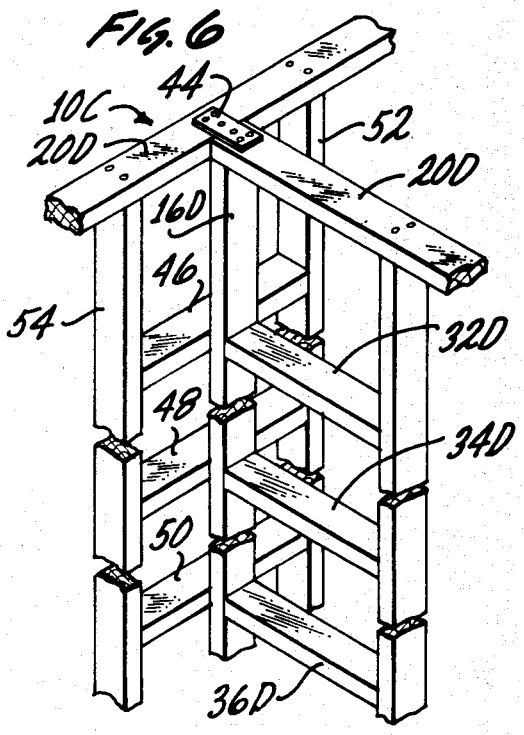
FIG. 6 is an isometric view of the inside corner shown in FIG. 5.

In FIGS. 5 and 6 two modular sections 10 are placed together so that they are mutually perpendicular forming an inside wall mating with an outside wall. For the purposes of identification the components on one modular section 10 forming a part of the outside wall will be identified by the numeral followed by the letter "C" and the components of the other modular section 10 forming the interior wall will be identified by the numeral followed by the letter "D".

At a point in the building wherein an interior wall attaches to an outside wall or wherever two interior walls come together such that one interior wall is perpendicular to the other, a third series of cross braces 46, 48 and 50 are placed in a manner identical as that previously described for the other cross braces, between two interior studs 52 and 54 in modular section 10C. Modular section 10D is placed perpendicular to modular section 10C at any point along the space inbetween interior studs 52 and 54 and is attached to modular section 10C by nails, plates or other attaching means traversing between cross braces 46, 48 and 50 and end stud 16D. Additionally, a plate strap 44 can be used to attach top plate 20C to top plate 20D. As with an outside corner, this type of construction results in saving of lumber, e.g., instead of using two 8-foot 2×4's in attaching the two walls together, only three 2-foot 2×4's, for a total of six feet, are used.

The individual modular sections can be prefab in a factory using either machinery or by hand labor. Additionally the units could also be prepared on the job site in a manner similar to the on site formed walls now made. Alternately, certain modular units could be made in a factory and when the final structure is being completed on the site, construction labor could be utilized to add cross braces such as braces 46, 48 and 50 based upon the alignment of walls with respect to one another.

Typically in building a structure using the modular sections herein described a slab is poured without any anchor bolts incorporated within the slab. This allows the slab to be finished such that the area underneath the sole plate is level and smooth and thus the sole plate will fit tightly against the slab. The intact modular section is attached to the slab by using one-half inch redhead bolts or a similar anchoring method. After the walls of the building are complete using the previously described modular sections, drywall can be attached to the sections in the customary fashion. At the corners on one side, the drywall is attached to the cross braces. Because the cross braces are located wherever two modular sections intersect forming intersecting walls, there always is sufficient framing for attaching the drywall.

In using modular sections in interior walls, trimmers can be eliminated around the doorway because they are not needed for structural integrity. Further, along with interior doorways, windows in the exterior walls do not need cripples, again because the modular sections provide for structural integrity. Combined with the modular sections headers formed out of laminated plywood are preferred for use over windows and doorways. If it is desired to insulate outside walls which are formed of modular sections as can be seen in FIG. 4, insulation can be placed in all spaces around a corner except for the two-inch portion of end stud 14A. This effectively reduces heat transfer through the walls of a structure constructed using the modular sections.

I claim:

1. In a wall construction of the type having horizontal sole plates resting on a foundation or other supporting structure and a series of vertical studs extending from said sole plates, the improvement which comprises:

said wall construction being divided into individual modular sections, each individual modular section including a sole plate, said sole plate capable of being fastened to said foundation or other supporting structure, said sole plate having a first and and a second end;

a top plate, said top plate having a first end and a second end;

a first vertical end stud, said first vertical end stud having a top end and a bottom end;

a second vertical end stud, said second vertical end stud having a first end and a second end;

said bottom end of said first vertical end stud attaching to said first end of said sole plate such that said first vertical end stud rests on and is perpendicular to said sole plate;

said bottom end of said second vertical end stud attaching to said second end of said sole plate such that said second vertical end stud rests on and is perpendicular to said sole plate and parallel to said first end stud;

said first end of said top plate resting on and attaching to said top end of said first end stud, and said end of said top plate resting on and attaching to said top end of said second stud, said sole plate, said top plate, said first end stud and said second end stud all lying in the same plane and mutually forming a quadrilaterial;

an intermediate vertical member, said intermediate vertical member extending between said top plate and said sole plate and lying in the same plane as and parallel to said first and said second end studs, a first plurality of horizontal cross braces, each of said first plurality of cross braces extending substantially perpendicular to said first end stud and attached to said first end stud and said intermediate vertical member, a second plurality of horizontal cross braces, each of said second plurality of cross braces extending substantially perpendicular to said second end stud and attached to said second end stud and said intermediate vertical member, said intermediate vertical member comprising at least one interior vertical stud, individual modular sections being joined together to form said wall construction and including at least one corner in said wall construction comprising two of said modular sections joined together such that one of said first or second vertical end studs of one of said modular sections forming said corner has one side abutted against the outer surface of one of said first or said second vertical end studs of the other of said modular sections forming said corner, and a portion of each of said plurality of horizontal cross braces which are attached to said abutting vertical end stud of said one of said modular sections forming said corner directly overlays the vertical end stud of said other modular section and (are coplaner with) is in an essentially horizontal alignment with one of the horizontal cross braces of the other modular section forming said corner such that said corner contains only two vertical end studs one from said one of said pair of modular sections and the other from said other of said modular sections forming said corner; and attaching means for attaching said first end stud, said second end stud and said intermediate vertical member to said sole plate and said top plate, for attaching said cross braces to said first end stud, said second end stud and said intermediate vertical member, and said abutting studs at said corners to each other.

2. The wall construction of claim 1 wherein:

said intermediate vertical member comprises one interior vertical stud and said first plurality of horizontal cross braces attaches to said first end stud and said interior vertical stud, and said second plurality of horizontal braces attaches to said second end stud and said interior vertical stud.

3. The wall construction of claim 1 wherein:

said first and said second plurality of horizontal cross braces each comprise at least two cross braces spaced between said sole plate and said top plate.

4. The wall construction of claim 3 wherein:

said first and said second plurality of horizontal cross braces each constitute three cross braces symmetrically spaced between said sole plate and said top plate.

5. The wall construction of claim 4 wherein:

said cross braces are spaced at a distance of about two feet, four feet and six feet from said sole plate.

6. The wall construction of claim 1 wherein:

said intermediate member comprises at least two vertical interior studs.

7. The wall construction of claim 6 including:

a third plurality of horizontal cross braces, said third plurality of cross braces extending substantially perpendicular to and between two adjacent interior vertical studs.

8. The wall construction of claim 1 including at least one perpendicular wall being formed in said wall construction, said perpendicular wall being formed by a first individual modular section having a third plurality of horizontal cross braces, said third plurality of horizontal cross braces extending substantially perpendicular to and between two adjacent interior vertical studs;

a second individual modular section, said second individual modular section located substantially perpendicular to said first individual modular section and attaching to said first individual modular section by abutting one of said first or said second vertical end stud of said second individual modular section against said third plurality of horizontal cross braces and attaching said abutting vertical end stud of said second individual modular section to said third plurality of horizontal cross braces such that the only vertical end stud located at the point of attachment of said first and said second modular section is said one of said first or said second end studs of said second individual modular section.

* * * * *

UNITED STATES PATENT AND TRADEMARK OFFICE

CERTIFICATE OF CORRECTION

PATENT NO. : 4,281,491

DATED : August 4, 1981

INVENTOR(S) : Ernest A. Schonert

It is certified that error appears in the above-identified patent and that said Letters Patent are hereby corrected as shown below:

Column 1, line 53, the word "As" should read --An--.

Column 2, line 1, the word "foot" should read --inch--.

Column 7, line 27, (Claim 1) the word "first" should read --top-- and the word "second" should read --bottom--.

Column 7, line 38, (Claim 1) "and said end" should read --and said second end--.

Column 8, line 6, (Claim 1) delete the parentheses and words "(are coplanar with)".

Signed and Sealed this

*Twenty-sixth* Day of *January 1982*

[SEAL]

*Attest:*

GERALD J. MOSSINGHOFF

*Attesting Officer*

*Commissioner of Patents and Trademarks*